US008888208B2

(12) United States Patent
Cyman, Jr. et al.

(10) Patent No.: US 8,888,208 B2
(45) Date of Patent: Nov. 18, 2014

(54) SYSTEM AND METHOD FOR REMOVING AIR FROM AN INKJET CARTRIDGE AND AN INK SUPPLY LINE

(71) Applicant: R. R. Donnelley & Sons Company, Chicago, IL (US)

(72) Inventors: Theodore F. Cyman, Jr., Grand Island, NY (US); Anthony V. Moscato, North Tonawanda, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 13/841,668

(22) Filed: Mar. 15, 2013

(65) Prior Publication Data

US 2013/0286062 A1 Oct. 31, 2013

Related U.S. Application Data

(60) Provisional application No. 61/639,541, filed on Apr. 27, 2012.

(51) Int. Cl.
*B41J 29/38* (2006.01)
*B41J 2/175* (2006.01)

(52) U.S. Cl.
CPC ..... *B41J 2/17596* (2013.01); *B41J 2/175* (2013.01)
USPC ..... 347/6; 347/89

(58) Field of Classification Search
CPC ..... B41J 2/17596; B41J 2/18; B41J 2/19; B41J 2/17566; B41J 2/1707; B41J 2/17563
See application file for complete search history.

(56) References Cited

U.S. PATENT DOCUMENTS

| | | | |
|---|---|---|---|
| 3,560,641 | A | 2/1971 | Taylor et al. |
| 3,647,138 | A | 3/1972 | Houser |
| 3,723,645 | A | 3/1973 | Takami et al. |
| 3,747,120 | A | 7/1973 | Stemme |
| 3,891,121 | A | 6/1975 | Stoneburner |

(Continued)

FOREIGN PATENT DOCUMENTS

| | | |
|---|---|---|
| EP | 0585901 | 3/1994 |
| EP | 0 749 836 | 12/1996 |

(Continued)

OTHER PUBLICATIONS

Intl. Search Report dated Sep. 8, 2008, Appl. No. PCT/US2008/008114 (8 pages).

(Continued)

*Primary Examiner* — Juanita D Jackson
(74) *Attorney, Agent, or Firm* — McCracken & Gillen LLC

(57) ABSTRACT

A printing system includes an inkjet cartridge, an ink reservoir, and a reversible pump. A method and system of operating the printing system are providing in which first fluid line couples the ink reservoir and an input port of the inkjet cartridge. A second fluid line couples the reversible pump and an output port of the inkjet cartridge. The reversible pump is operated in a first direction to supply ink from the ink reservoir to the ink jet cartridge via the first fluid line. The reversible pump is a second direction to supply ink from the ink reservoir to the inkjet cartridge via the second fluid line. The reversible pump is operated in the first direction and the second direction repeatedly and sequentially for a predetermined duration.

18 Claims, 3 Drawing Sheets

(56) References Cited

U.S. PATENT DOCUMENTS 3,974,508 A 8/1976 Blumenthal
4,042,937 A 8/1977 Perry et al.
4,050,078 A 9/1977 Isayama et al.
4,051,538 A 9/1977 Fox et al.
4,063,254 A 12/1977 Fox et al.
4,067,020 A 1/1978 Arway
4,116,626 A 9/1978 Varner
4,126,868 A 11/1978 Kirner
4,184,167 A 1/1980 Vandervalk
4,208,666 A 6/1980 Paranjpe
4,222,080 A 9/1980 Frazier
4,240,082 A 12/1980 Yu
4,250,512 A 2/1981 Kattner et al.
4,260,996 A 4/1981 Wittwer
4,296,418 A 10/1981 Yamazaki et al.
4,317,124 A 2/1982 Shirato et al.
4,330,787 A 5/1982 Sato et al.
4,362,572 A 12/1982 Wallace
4,403,229 A 9/1983 Barteck
4,410,897 A 10/1983 Moriguchi et al.
4,432,005 A 2/1984 Duffield et al.
4,494,124 A 1/1985 Piatt et al.
4,520,366 A 5/1985 Cragin, Jr.
4,528,996 A 7/1985 Jones
4,542,389 A 9/1985 Allen
4,571,600 A 2/1986 Hara
4,593,295 A 6/1986 Matsufuji et al.
4,598,303 A 7/1986 Peekema et al.
4,598,329 A 7/1986 Nelson
4,607,266 A 8/1986 DeBonte
4,623,897 A 11/1986 Brown et al.
4,628,329 A 12/1986 Regnault
4,706,099 A 11/1987 Suzuki
4,812,859 A 3/1989 Chan et al.
4,814,794 A 3/1989 Sato
4,825,229 A 4/1989 Matsumoto et al.
4,835,544 A 5/1989 Winterburn
4,881,132 A 11/1989 Lajos
5,087,805 A 2/1992 Silverschotz et al.
5,126,752 A 6/1992 Weinberg
5,126,766 A 6/1992 Terasawa et al.
5,182,578 A 1/1993 Goepel et al.
5,210,550 A 5/1993 Fisher et al.
5,211,493 A 5/1993 Stephenson et al.
5,272,491 A 12/1993 Asakawa et al.
5,369,429 A 11/1994 Erickson
5,382,969 A 1/1995 Mochizuki et al.
5,428,375 A 6/1995 Simon et al.
5,446,486 A 8/1995 Reis
5,504,510 A 4/1996 Miyakawa
5,512,924 A 4/1996 Takada et al.
5,543,827 A 8/1996 VanSteenkiste et al.
5,585,825 A 12/1996 Kneezel et al.
5,598,198 A 1/1997 Taylor et al.
5,631,676 A 5/1997 Karz
5,646,666 A 7/1997 Cowger et al.
5,657,061 A 8/1997 Seccombe et al.
5,670,995 A 9/1997 Kupcho et al.
5,735,617 A 4/1998 Wirth
5,751,327 A 5/1998 De Cock et al.
5,765,481 A 6/1998 Tortora et al.
5,774,141 A 6/1998 Cooper et al.
5,784,077 A 7/1998 Silverbrook
5,793,389 A 8/1998 Mitchell
5,796,411 A 8/1998 Cyman
5,797,305 A 8/1998 Harrod et al.
5,812,151 A 9/1998 Kishine et al.
5,825,380 A 10/1998 Ichizawa et al.
5,877,788 A 3/1999 Haan et al.
5,877,793 A 3/1999 Erickson
5,903,293 A 5/1999 Nikkels et al.
5,929,878 A 7/1999 Pelletier
5,949,438 A 9/1999 Cyman et al.
5,992,990 A 11/1999 Childers et al.
6,000,792 A 12/1999 Koizumi et al.
6,003,988 A 12/1999 McCann et al.
6,023,594 A 2/2000 Okiyama et al.
6,030,074 A 2/2000 Barinaga
6,033,061 A 3/2000 Niedermeyer et al.
6,089,693 A 7/2000 Drake et al.
6,120,142 A 9/2000 Eltgen et al.
6,164,768 A 12/2000 Murphy et al.
6,224,192 B1 5/2001 Robinson et al.
6,224,198 B1 5/2001 Cook et al.
6,231,174 B1 * 5/2001 Haigo ..... 347/89
6,234,597 B1 5/2001 Suzuki et al.
6,234,617 B1 5/2001 Niedermeyer et al.
6,267,518 B1 7/2001 Abe
6,273,103 B1 8/2001 Enz et al.
6,335,978 B1 1/2002 Moscato et al.
6,344,904 B1 2/2002 Mercer
6,347,858 B1 2/2002 Faisst, Jr. et al.
6,357,854 B1 3/2002 Igval et al.
6,364,451 B1 4/2002 Silverbrook
6,402,293 B1 6/2002 Sawicki
6,428,156 B1 8/2002 Waller et al.
6,435,637 B1 8/2002 Lyman
RE37,874 E 10/2002 Pawlowski, Jr. et al.
6,460,441 B1 10/2002 Harrod
6,467,874 B1 10/2002 Williams et al.
6,530,644 B2 3/2003 Premnath et al.
6,536,863 B1 3/2003 Beauchamp et al.
6,547,370 B2 4/2003 Mantell et al.
6,575,554 B2 6/2003 Yoshinaga
6,585,350 B2 7/2003 Barinaga
6,601,951 B2 8/2003 Kuwabara et al.
6,637,860 B1 10/2003 Madeley
6,660,103 B1 12/2003 Johnston et al.
6,663,220 B2 12/2003 Suzuki et al.
6,663,304 B2 12/2003 Vives et al.
6,669,327 B1 12/2003 Harper
6,672,702 B2 1/2004 Sadasivan et al.
6,679,590 B2 1/2004 Enz
6,688,721 B1 2/2004 Serra
6,733,106 B1 5/2004 Leemhuis
6,802,588 B2 10/2004 Garbacz et al.
6,808,246 B2 10/2004 Long
6,811,249 B2 11/2004 DeVries et al.
6,830,315 B2 12/2004 Silverbrook
6,843,553 B2 1/2005 Ishii et al.
6,869,160 B2 3/2005 West et al.
6,880,912 B2 4/2005 Klausbruckner et al.
6,890,053 B2 5/2005 Myhill et al.
6,908,165 B2 6/2005 Pinard
6,916,132 B2 7/2005 Otsuka et al.
6,935,729 B2 8/2005 De Marco et al.
6,991,311 B2 1/2006 Su et al.
7,040,729 B2 5/2006 Richards
7,070,250 B2 7/2006 Lester et al.
7,103,306 B2 9/2006 Shimizubata
7,178,900 B2 2/2007 Blouin et al.
7,212,319 B2 5/2007 Mercer
7,222,955 B2 5/2007 Ohashi
7,306,316 B2 12/2007 Doak
7,384,119 B2 6/2008 Karppinen et al.
7,401,888 B2 7/2008 Karppinen et al.
7,455,377 B2 11/2008 Espasa et al.
7,931,359 B2 4/2011 Esdaile-Watts et al.
7,967,425 B2 6/2011 Dyer et al.
2001/0050697 A1 12/2001 Jackson
2003/0016267 A1 1/2003 Green
2004/0021716 A1 2/2004 Serra
2004/0066428 A1 4/2004 West et al.
2004/0207708 A1 10/2004 Ohashi et al.
2004/0234303 A1 11/2004 Shimizubata
2005/0099438 A1 5/2005 Lester et al.
2005/0099469 A1 5/2005 Encrenaz et al.
2005/0157115 A1 7/2005 Silverbrook
2005/0219589 A1 10/2005 Mercer
2005/0248608 A1 11/2005 DeVivo et al.
2005/0253886 A1 11/2005 Nakajima et al.
2005/0264620 A1 12/2005 Kuester et al.
2006/0274130 A1 12/2006 Self et al.
2007/0080988 A1 4/2007 Karppinen et al.

(56) References Cited

U.S. PATENT DOCUMENTS

| | | | |
|---|---|---|---|
| 2007/0081026 | A1 | 4/2007 | Karppinen et al. |
| 2007/0091152 | A1 | 4/2007 | Rademakers et al. |
| 2007/0188542 | A1 | 8/2007 | Kanfoush et al. |
| 2007/0195144 | A1 | 8/2007 | McNestry |
| 2008/0099508 | A1 | 5/2008 | Son et al. |
| 2008/0100660 | A1 | 5/2008 | Perrin et al. |
| 2008/0264498 | A1 | 10/2008 | Thompson et al. |
| 2009/0284563 | A1 | 11/2009 | Bansyo |
| 2011/0148988 | A1 | 6/2011 | Hoisington et al. |

FOREIGN PATENT DOCUMENTS

| | | | |
|---|---|---|---|
| EP | 1389530 | | 2/2004 |
| EP | 1979168 | | 10/2008 |
| GB | 2 280 149 | A | 1/1995 |
| JP | 62-218139 | A | 9/1987 |
| JP | 10-324038 | A | 12/1998 |
| WO | WO 96-35584 | | 11/1996 |
| WO | WO 2007-092489 | | 8/2007 |
| WO | WO 2009-005765 | | 1/2009 |

OTHER PUBLICATIONS

International Search Report and Written Opinion in PCT/US2007/03239, dated Feb. 20, 2008.

International Preliminary Report on Patentability in Appl. No. PCT/US07/03239 dated Aug. 14, 2008.

International Preliminary Report on Patentability, dated Jan. 5, 2010, Appl. No. PCT/US2008/008114.

Supplementary European Search Report, dated Nov. 14, 2008, Appl. No. EP07763393.

* cited by examiner

SYSTEM AND METHOD FOR REMOVING AIR FROM AN INKJET CARTRIDGE AND AN INK SUPPLY LINE

CROSS REFERENCE TO RELATED APPLICATIONS

The present application claims benefit of Cyman Jr., et al., U.S. Provisional Patent Application No. 61/639,541 filed on Apr. 27, 2012. The entire contents of such application are incorporated herein by reference.

BACKGROUND OF THE INVENTION

1. Field of the Invention

The present disclosure relates generally to inkjet printing systems and more particularly a system and method for removing air from an inkjet cartridge and ink supply line therefor.

2. Description of the Background of the Invention

High-speed printing systems typically include one or more imaging units. Each imaging unit has one or more inkjet cartridges and a controller controls each inkjet cartridge to eject a fluid such as ink or other composition) onto a receiving surface. Each inkjet cartridge includes a nozzle plate that includes a plurality of orifices (nozzles) through which ink from inside the inkjet cartridge may be controllably ejected.

An inkjet cartridge typically includes a fluid chamber and one or more nozzles. Pressure inside of the fluid chamber is increased relative to ambient air pressure to force a drop of fluid through the nozzle(s). Some inkjet cartridges use a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. A controller controls the current that is passed through the piezoelectric element to control the deformation thereof or to control the current through the heating element in turn to control the temperature thereof so that drops are formed when needed. Other types of inkjet technologies known in the art may be used in the printing systems described herein.

In a printing system, an inkjet cartridge may be secured to a carrier and disposed such that the nozzles of the inkjet cartridge are directed toward the receiving surface. The carrier may be manufactured from steel or other alloys that can be milled to a high precision. More than one inkjet cartridge may be secured to a carrier in this fashion in a one or two-dimensional array. Moscato et al., U.S. Provisional Patent Application Ser. No. 61/523,079, filed Aug. 11, 2011, discloses one such apparatus and method for disposing inkjet cartridges in a carrier. Kanfoush et al., U.S. Provisional Patent Application No. 61/535,150 filed Sep. 15, 2011, discloses an apparatus and method for disposing an inkjet cartridge in a mount that may be secured to the carrier. The entire contents of U.S. Provisional Patent Application Nos. 61/523,079 and 61/535,150 are incorporated herein by reference.

Dried ink, dust, paper fibers, and other debris can collect on a nozzle plate or in a nozzle of an inkjet cartridge and prevent proper ejection of ink from the nozzles thereof. The controller of a printing system can undertake periodic cleaning cycles during which ink is purged from the nozzle to release any debris in or near such nozzle. The purged ink and/or debris must be removed from the nozzle plate in the vicinity of the nozzles so that such purged ink and/or debris does not collect thereon and dry to create further debris that will later interfere with ejection of ink from nozzles of the cartridge. Moscato et al., U.S. Provisional Application No. 61/685,002, filed Mar. 9, 2012, discloses a system and method of cleaning inkjet cartridges, the entire contents of which are incorporated herein by reference.

Ink is supplied to each inkjet cartridge from an ink reservoir via an ink line. If air becomes trapped in the ink line and flows into the fluid chamber of the inkjet cartridge during printing, such air may interfere with the proper ejection of ink from the nozzles of the inkjet cartridge.

SUMMARY OF THE INVENTION

According to one aspect of the present invention, a printing system includes an inkjet cartridge, an ink reservoir, and a reversible pump. The printing system also includes a first fluid line that couples the ink reservoir and an input port of the inkjet cartridge, and a second fluid line that couples the reversible pump and an output port of the inkjet cartridge. The printing system further includes a controller that repeatedly operates the reversible pump sequentially in a first direction and a second direction. Operating the reversible pump in the first direction supplies ink from the ink reservoir to the inkjet cartridge via the first fluid line, and operating the reversible pump in the second direction supplies ink from the ink reservoir to the inkjet cartridge via the second fluid line.

According to another aspect of the present invention, a method of operating a printing system, which includes an inkjet cartridge, an ink reservoir, and a reversible pump, includes the steps of providing a first fluid line and providing a second fluid line. The first fluid line couples the ink reservoir and an input port of the inkjet cartridge, and the second fluid line couples the reversible pump and an output port of the inkjet cartridge. The method includes the further step of operating the reversible pump in a first direction to supply ink from the ink reservoir to the ink jet cartridge via the first fluid line. In addition, the method includes the step of operating the reversible pump in a second direction to supply ink from the ink reservoir to the inkjet cartridge via the second fluid line. Operating the reversible pump in the first direction and operating the reversible pump in the second direction are undertaken repeatedly and sequentially for a predetermined duration.

DETAILED DESCRIPTION OF THE PREFERRED EMBODIMENTS

Figure 1:
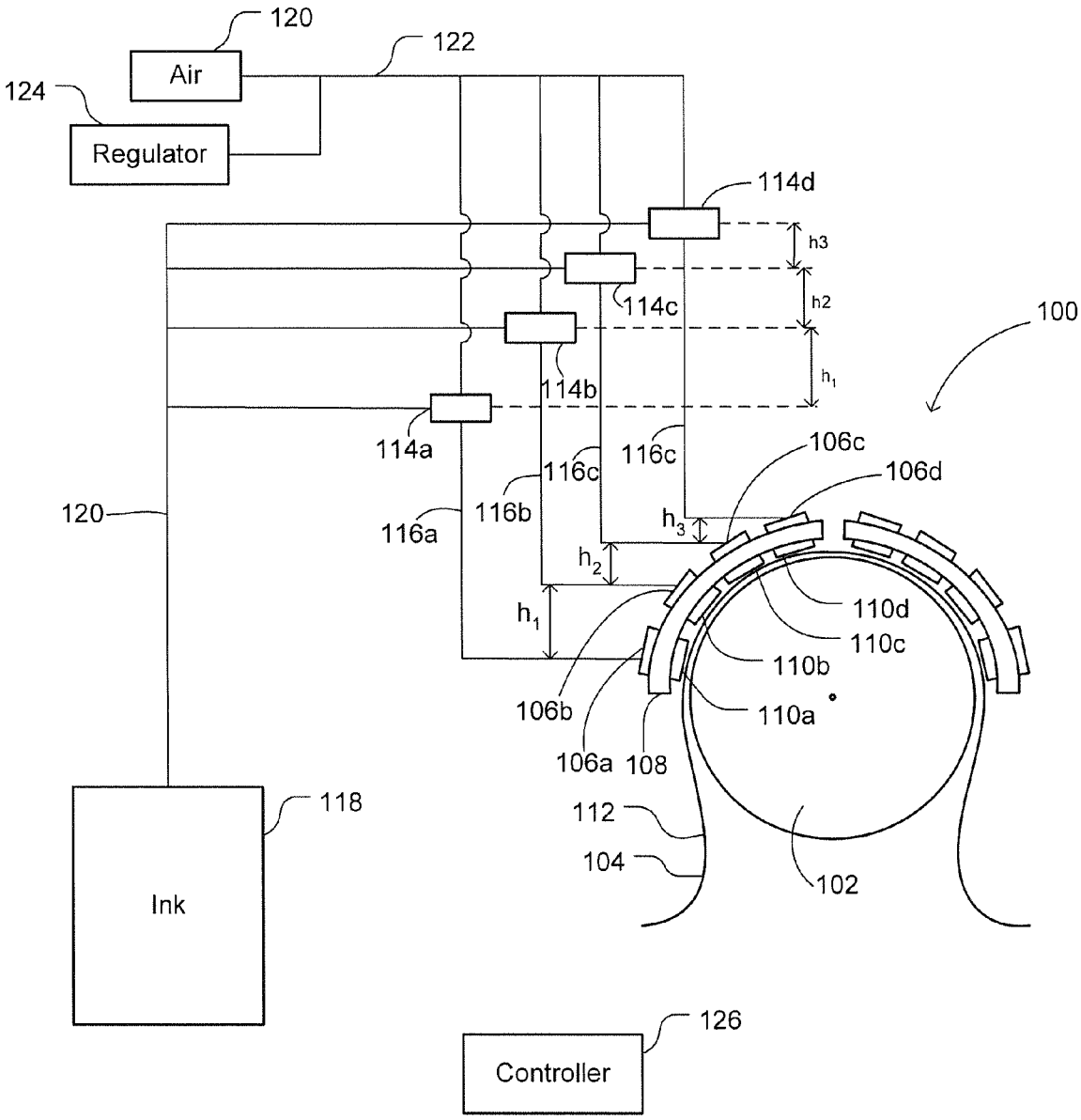
FIG. 1 is a schematic representation of an inkjet printing system according to the present disclosure.

Referring to FIG. 1, a printing system 100 includes a drum 102 about the circumference of which paper 104 may be transported. The printing system 100 also includes inkjet cartridges 106 disposed in a carrier 108 such that nozzle plates 110 of the inkjet cartridges 106 face an outer surface 112 of the paper 104. Ink is supplied to the inkjet cartridges 106 from intermediate ink reservoirs 114 via ink lines 116. A common ink tank 118 supplies ink to the ink reservoirs 114 via a common ink line 120. As described below, a compressed gas (such as air, an inert gas, or nitrogen) is supplied at a certain pressure from a gas source 120 to the ink reservoirs 114 via a gas line 122. At other times, a vacuum regulator 124 is used to generate a negative pressure in the gas line 122. A controller 126 is used to control the operation of the printing system 100 and the supply of ink thereto.

As described below, filters, valves and pumps may be disposed along the ink lines 116, the common ink line 120, and the gas line 122 to control the flow of ink and/or gas therethrough.

In one embodiment, the inkjet cartridges 106 are distributed radially about the drum 102 so that that the height of the each inkjet cartridge 106*a*, 106*b*, 106*c*, and 106*d* relative the common ink tank 118 is different. If the ink reservoirs 114*a*, 114*b*, 114*c*, and 114*d* were disposed at identical heights relative to the common ink tank 118, the pressure with which ink would be supplied to each of the corresponding inkjet cartridges 106*a*, 106*b*, 106*c*, and 106*d*, respectively, would be different. To prevent such difference in pressure, the ink reservoirs 114*a*, 114*b*, 114*c*, and 114*d* are disposed so that the height differences between the ink reservoirs 114*a*, 114*b*, 114*c*, and 114*d* are identical to the height differences between the inkjet cartridges 106*a*, 106*b*, 106*c*, and 106*d*, respectively. For example, if the height difference between the inkjet cartridges 106*a* and 106*b* is $h_1$, then the ink reservoirs 114*a* and 114*b* are disposed such that the height difference therebetween is substantially identical to $h_1$. Similarly, if the height differences between inkjet cartridges 106*b* and 106*c* is $h_2$ and the height difference between inkjet cartridges 106*c* and 106*d* is $h_3$, then the ink reservoirs 114*b*, 114*c*, and 114*d* are positioned such that the height difference between ink reservoirs 114*b* and 114*c* is substantially identical to $h_2$ and the height difference between 114*c* and 114*d* is substantially identical to $h_3$.

In some embodiments, the ink reservoir 114*a* supplies ink to the inkjet cartridge 106*a* and other cartridges disposed in the carrier 108 that are at a height substantially identical to the height of the inkjet cartridge 106*a*. Similarly, the ink reservoirs 114*b*, 114*c*, and 114*d* supply ink to cartridges disposed in the carrier 108 that are at a height substantially identical to the height of the inkjet cartridges 106*b*, 106*c*, and 106*d*, respectively.

Figure 2:
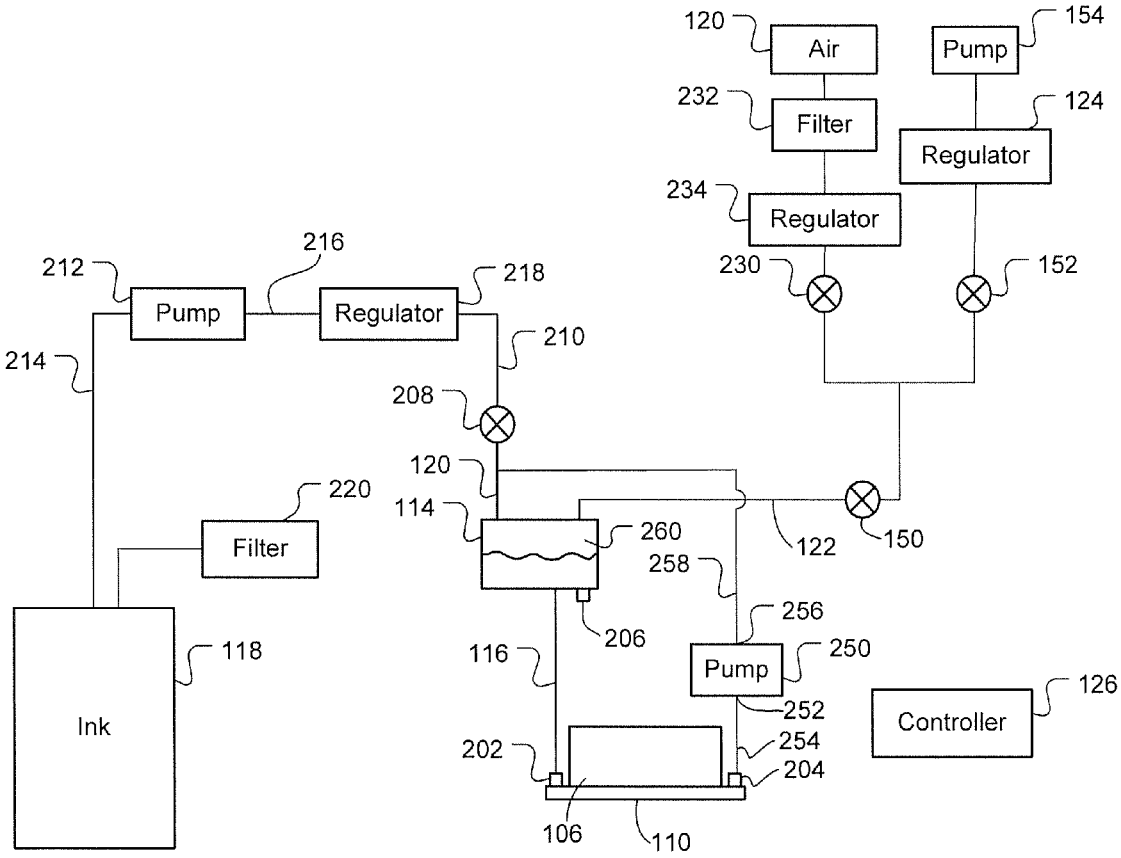
FIG. 2. is a schematic representation of an inkjet cartridge, an ink supply, a cleaning system, and air removal system of the printing system of FIG. 1.

Referring to FIG. 2, the inkjet cartridge 106 has an input port 202 and an output port 204. Ink is supplied from the ink reservoir 114 to the input port 202 via the ink line 116. Further, when the inkjet cartridge 106 is idle or being used for printing, the ink from the ink reservoir 114 is supplied at a negative pressure relative to ambient pressure to prevent ink inadvertently escaping from the nozzles of the inkjet cartridge 110. To maintain such negative pressure, the controller 126 operates the vacuum regulator 124 and opens the valves 150 and 152 to couple the gas line 122 to the vacuum regulator 124 and closes the valve 230. Typically, the vacuum regulator 124 is operated to generate a vacuum equivalent to approximately −48 inches of water. A pump 154 is operated as necessary to exhaust air into the atmosphere in order to allow the vacuum regulator 124 to operate properly.

During operation of the inkjet cartridge 106, ink is ejected from the nozzles disposed on the nozzle plate 110. Ejection of the ink from the nozzles causes additional ink to be drawn from the ink reservoir 114 via the ink line 116. The controller 126 receives from a sensor 206 a signal that represents the amount of ink available in the ink reservoir 114. If the amount of ink available falls below a predetermined amount, the controller 126 actuates a valve 208, for example, a solenoid valve, to supply ink from an ink line 210 to the ink reservoir 114 via the ink line 120.

A pump 212 draws ink from the ink tank 118 via an ink line 214 and supplies such ink to an ink line 216. In one embodiment, the pump 212 is a pressure pump with an accumulator and maintains the pressure of the ink in the ink line 216 at approximately 30 pounds-per-square-inch (psi). A pressure regulator 218 draws ink from the ink line 216 and supplies ink to the ink line 210 at a pressure between approximately 15 psi and 30 psi.

As ink is drawn from the ink tank 118, outside air is drawn into the ink tank 118. In some embodiments, a filter 220 removes any contaminants from the outside air before such air is introduced into the ink tank 118.

Periodically, the controller 126 initiates a cleaning cycle to clean the nozzles disposed in the nozzle plate 110 of the inkjet cartridge 106 and the area surrounding such nozzles. During such cleaning cycle, the controller 126 keeps the valve 150 open and closes the valve 152. Substantially concurrently, the controller 126 opens a valve 230 to introduce pressurized gas from the compressed gas source 120 into the ink reservoir 114 via the gas line 122, thereby increasing the pressure in the ink reservoir 114. Such increase in pressure forcibly transfers ink from the ink reservoir 114, through the ink line 116, and through the nozzles in the nozzle plate 110 of the inkjet cartridge 106. After such cleaning cycle is complete, the controller 126 closes the valve 230 and opens the valve 152 to restore the negative pressure in the ink reservoir 114.

In one embodiment, the compressed gas source 120 supplies gas through a filter 232 and to a pressure regulator 234 at a pressure between approximately 15 psi and 100 psi. During the cleaning cycle, the controller 126 controls the pressure regulator 234 such that gas is supplied through the valves 230 and 150 and into the gas line 122 is at approximately 15 psi pressure.

The controller 126 may also undertake an air removal cycle to remove any air trapped inside the ink line 116 or the fluid chamber of the inkjet cartridge 106. During the air removal cycle, the controller 126 closes the valve 150, and optionally valves 230 and/or 152. The controller 126 concurrently operates a reversible pump 250. One port 252 of the reversible pump 250 is coupled to the output port 204 via an ink line 254. Another port 256 of the reversible pump 250 is coupled to the ink line 120 via an ink line 258. During a first portion of air removal cycle, the controller 126 operates the reversible pump 250 in a first direction that draws ink from the ink reservoir 114, through the ink line 116, the inkjet cartridge 106, and the ink line 254 and returns such ink into the ink reservoir 114 via the ink lines 258 and 120.

During a second portion of the air removal cycle, the controller 126 operates the reversible pump 250 in a second direction, opposite the first direction, to draw ink from the ink reservoir 114 and through the ink lines 120 and 258. The reversible pump 250 thereafter pumps such drawn ink through the ink line 254 and the inkjet cartridge 106 and returns the ink to the ink reservoir 114 via the ink line 116.

The first and second portions of the air removal cycle are repeated to remove air trapped in the ink lines 116, 254, and 258 and the fluid chamber of the inkjet cartridge 106. Repeating the first and second portions of the air removal cycle may agitate the fluid in the ink lines 116, 254, 258 and the fluid chamber of the ink cartridge 106 sufficiently to dislodge any air bubbles trapped therein and transport such bubbles to the ink reservoir 260.

Operation of the reversible pump 250 in this manner transports into the ink reservoir 114 any air in the ink lines 116, 254, 258, and 120 and the fluid chamber of the inkjet cartridge 106. Such air may thereafter form a bubble that is escapes into the tillage 260 above the ink in the ink reservoir 114. In one embodiment, the reversible pump 250 is a peristaltic pump. It should be apparent that other types of reversible pumps may be used.

Figure 3A:
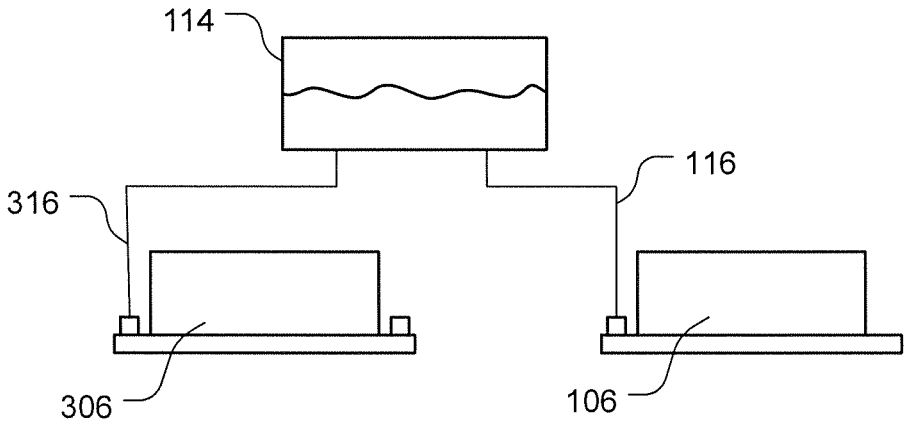
FIGS. 3A and 3B are schematic representations of another embodiment an air removal system of FIG. 1.
Figure 3B:
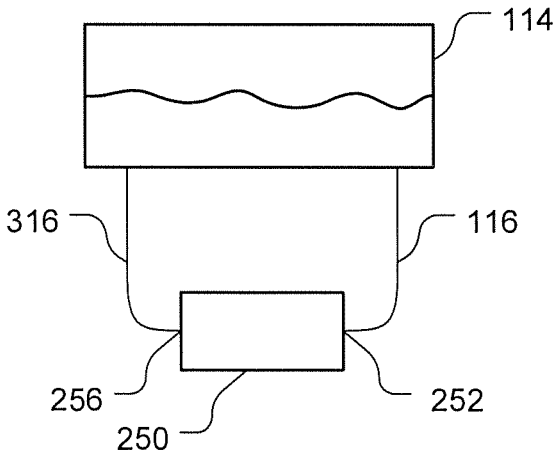

In some embodiments, the pump 250 may be used to remove air bubbles from two lines that supply ink to two different inkjet cartridges. As noted above, the ink reservoir 114 may supply ink to a plurality of inkjet cartridges 106. Referring to FIG. 3A, in one embodiment, the ink reservoir 114 supplies ink to a first inkjet cartridge 106 via line 116 as described above. The ink reservoir 114 also supplies ink to a second inkjet cartridge 306 via line 316. Lines from the ink reservoir 114 to other components are omitted from FIGS. 3A and 3B for sake of clarity. Referring to FIG. 3B, to eliminate air bubbles from the lines 316 and 116, an operator disconnects the line 116 from the inkjet cartridge 106 and connects such line to the port 252 of the pump 250. The operator disconnects the line 316 from the inkjet cartridge 306 and connects such line to the port 256 of the pump 250. The controller 126 then operates the pump 250 in a first direction for a first period of time to draw ink from the ink supply 114 through the line 316 and return the ink to the ink supply 114 through the line 116. Thereafter, the controller 126 operates the pump 250 in a second direction for a second period of time to draw ink from the ink reservoir 114 through the line 116 and returns the ink to the ink reservoir 114. The controller 126 operates the pump 250 in the first direction and the second direction a predetermined number of times or for a predetermined duration. As discussed above, operating the pump 250 in this manner, releases any air bubbles that may be trapped in either of the lines 116 and 316. In some embodiments, the operator, rather than the controller, may operate the pump in the first direction and the second direction as described above.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the embodiments disclosed herein and to teach the best mode of carrying out same. The exclusive rights to all modifications that come within the scope of the present disclosure are reserved.

We claim:

1. A printing system, comprising:
- an inkjet cartridge;
- an ink reservoir;
- a reversible pump;
- a first fluid line that couples the ink reservoir and an input port of the inkjet cartridge;
- a second fluid line that couples the reversible pump and an output port of the inkjet cartridge;
- a supply of a gas coupled to the ink reservoir; and
- a controller that repeatedly operates the reversible pump sequentially in a first direction and a second direction, wherein operating the reversible pump in the first direction supplies ink from the ink reservoir to the inkjet cartridge via the first fluid line and operating the reversible pump in the second direction supplies ink from the ink reservoir to the inkjet cartridge via the second fluid line; and
- wherein the controller causes gas from the supply of the gas to be introduced into the ink reservoir and thereby causes ink to be released through a nozzle of the inkjet cartridge.

2. The printing system of claim 1, wherein ink is supplied to the ink reservoir from an ink tank.

3. The printing system of claim 2, wherein the inkjet cartridge is disposed in the printing system at a first vertical distance from the ink tank.

4. The printing system of claim 3, comprising a further inkjet cartridge and a further ink reservoir coupled thereto, wherein the further inkjet cartridge is disposed in the printing system at a second vertical distance from the ink tank.

5. The printing system of claim 4, wherein the vertical distance between the ink reservoir and the further ink reservoir is substantially identical to the difference between the first vertical distance and the second vertical distance.

6. The printing system of claim 2, further comprising a drum, wherein the inkjet cartridge and the further inkjet cartridge are disposed about the drum.

7. The printing system of claim 1, further comprising a third fluid line that couples the reversible pump to the ink reservoir.

8. The printing system of claim 7, wherein operating the reversible pump in the first direction further causes ink to be returned to the ink reservoir via the third fluid line.

9. The printing system of claim 7, wherein operating the reversible pump in the second direction further causes ink to be drawn from the ink reservoir through the third fluid line.

10. A method of operating a printing system, wherein the printing system includes an inkjet cartridge, an ink reservoir, and a reversible pump, comprising the steps of:
- providing a first fluid line that couples the ink reservoir and an input port of the inkjet cartridge;
- providing a second fluid line that couples the reversible pump and an output port of the inkjet cartridge;
- operating the reversible pump in a first direction to supply ink from the ink reservoir to the ink jet cartridge via the first fluid line;
- operating the reversible pump in a second direction to supply ink from the ink reservoir to the inkjet cartridge via the second fluid line;
- introducing a gas into the ink reservoir and, in response, causing ink to be released through a nozzle of the inkjet cartridge; and
- wherein the steps of operating the reversible pump in the first direction and operating the reversible pump in the second direction are undertaken repeatedly and sequentially for a predetermined duration.

11. The method of claim 10, comprising the further step of supplying ink to the ink reservoir from an ink tank.

12. The method of claim 11, comprising the further step of disposing the inkjet cartridge at a first vertical distance from the ink tank.

13. The method of claim 12, comprising the further steps of disposing a further inkjet cartridge at a second vertical distance from the ink tank and supplying ink to the further inkjet cartridge from a further ink reservoir coupled thereto.

14. The method of claim 13, comprising the further step of disposing the ink reservoir and the further ink reservoir such that the vertical distance between the ink reservoir and the further ink reservoir is substantially identical to the difference between the first vertical distance and the second vertical distance.

15. The method of claim 11, comprising the further step of disposing the inkjet cartridge and the further inkjet cartridge about a drum.

16. The method of claim 11, comprising the further step of disposing a third fluid line that couples the reversible pump and the ink reservoir.

17. The method of claim 16, wherein the step of operating the reversible pump in the first direction comprises the step of returning ink from the inkjet cartridge to the ink reservoir via the third fluid line.

18. The method of claim 16, wherein step of operating the reversible pump in the second direction comprises the step of drawing ink from the ink reservoir through the third fluid line.

* * * * *